US011602917B2

(12) United States Patent
Ogino et al.

(10) Patent No.: US 11,602,917 B2
(45) Date of Patent: Mar. 14, 2023

(54) BINDING DEVICE, BINDING MEMBER, AND IMAGE FORMING SYSTEM

(71) Applicant: FUJIFILM Business Innovation Corp., Tokyo (JP)

(72) Inventors: Takashi Ogino, Kanagawa (JP); Nobuhide Inaba, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/338,695

(22) Filed: Jun. 4, 2021

(65) Prior Publication Data

US 2022/0194046 A1 Jun. 23, 2022

(30) Foreign Application Priority Data

Dec. 23, 2020 (JP) ..... JP2020-213884

(51) Int. Cl.
*B31F 5/02* (2006.01)
*B65H 37/04* (2006.01)

(52) U.S. Cl.
CPC ..... *B31F 5/02* (2013.01); *B65H 37/04* (2013.01)

(58) Field of Classification Search
None
See application file for complete search history.

(56) References Cited

U.S. PATENT DOCUMENTS 8,899,568 B2 * 12/2014 Matsushita ..... B31F 5/02 270/58.08
9,315,356 B2 * 4/2016 Yoshida ..... B31F 5/02
9,914,280 B2 * 3/2018 Takashima ..... B31F 5/022
10,156,824 B2 12/2018 Makita et al.
10,406,772 B2 * 9/2019 Takahashi ..... B42C 1/12
10,479,637 B2 * 11/2019 Morinaga ..... B31F 5/02
10,501,279 B2 * 12/2019 Abe ..... B65H 37/04
10,632,706 B2 * 4/2020 Makita ..... B65H 37/04
10,654,240 B2 * 5/2020 Takahashi ..... B42B 5/00
2015/0314626 A1 * 11/2015 Kushida ..... B42B 5/00 412/38

FOREIGN PATENT DOCUMENTS

JP 2013180883 A * 9/2013
JP 2014-058362 4/2014
JP 2014121865 7/2014
JP 2018-065332 4/2018
JP 2018158796 10/2018

OTHER PUBLICATIONS

Espacenet machine translation of JP2013180883A; http://translationportal.epo.org/emtp/translate/?ACTION=description-retrieval&COUNTRY=JP&ENGINE=google&FORMAT=docdb&KIND=A&LOCALE=en_EP&NUMBER=2013180883&OPS=ops.epo.org/3.2&SRCLANG=ja&TRGLANG=en (Year: 2013).*

* cited by examiner

*Primary Examiner* — Leslie A Nicholson, III
(74) *Attorney, Agent, or Firm* — JCIPRNET

(57) ABSTRACT

A binding device includes: an upper teeth portion having at least one teeth row that forms unevenness in a recording material bundle; a lower teeth portion having at least one teeth row that forms unevenness in the recording material bundle and being paired with the upper teeth portion; and at least one holding portion that holds the recording material bundle at a position different from a position where the upper teeth portion and the lower teeth portion have a binding function, when binding processing is performed by the upper teeth portion and the lower teeth portion.

7 Claims, 11 Drawing Sheets

BINDING DEVICE, BINDING MEMBER, AND IMAGE FORMING SYSTEM

CROSS-REFERENCE TO RELATED APPLICATIONS

This application is based on and claims priority under 35 USC 119 from Japanese Patent Application No. 2020-213884 filed Dec. 23, 2020.

BACKGROUND

(i) Technical Field

The present disclosure relates to a binding device, a binding member, and an image forming system.

(ii) Related Art

Japanese Unexamined Patent Application Publication No. 2014-121865 discloses a sheet processing device including a binding unit having teeth portions. An end portion of at least a portion of each teeth portion has a round shape, and, when the teeth portions mesh with one another, a wrinkle and a breakage, that is, tearing of a sheet are not thereby caused. Thus, it is possible to prevent a binding force from decreasing.

SUMMARY

A type of binding devices performing binding processing without using a wire such as a staple performs binding processing on a bundle of recording materials by causing an upper teeth portion and a lower teeth portion to press and to partially deform the recording material bundle.

When such binding processing is performed by using the upper teeth portion and the lower teeth portion, the recording material bundle is partially deformed. At this time, if a recording material is broken, a tooth may be shifted or inclined in a direction where teeth are arranged side by side, and a binding force with which the recording material bundle is bound thereby decreases. In particular, in a case of a bundle including plural, for example, six or more recording materials, a tooth tends to be shifted or inclined, and the decreased binding force with which the recording material bundle is bound may be a problem.

Aspects of non-limiting embodiments of the present disclosure relate to suppressing a tooth from being shifted or inclined, compared with a case where an upper teeth portion and a lower teeth portion have only rows of teeth performing binding processing on a recording material bundle by partially deforming the recording material bundle.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a binding device including: an upper teeth portion having at least one teeth row that forms unevenness in a recording material bundle; a lower teeth portion having at least one teeth row that forms unevenness in the recording material bundle and being paired with the upper teeth portion; and at least one holding portion that holds the recording material bundle at a position different from a position where the upper teeth portion and the lower teeth portion have a binding function, when binding processing is performed by the upper teeth portion and the lower teeth portion.

BRIEF DESCRIPTION OF THE DRAWINGS

Exemplary embodiments of the present disclosure will be described in detail based on the following figures, wherein:

FIG. 6A illustrates a state where the upper teeth portion has advanced slightly, and FIG. 6B illustrates a state where the upper teeth portion has further advanced;

DETAILED DESCRIPTION

First Exemplary Embodiment

Hereinafter, exemplary embodiments according to the present disclosure will be described with reference to the accompanying drawings.

Figure 1:
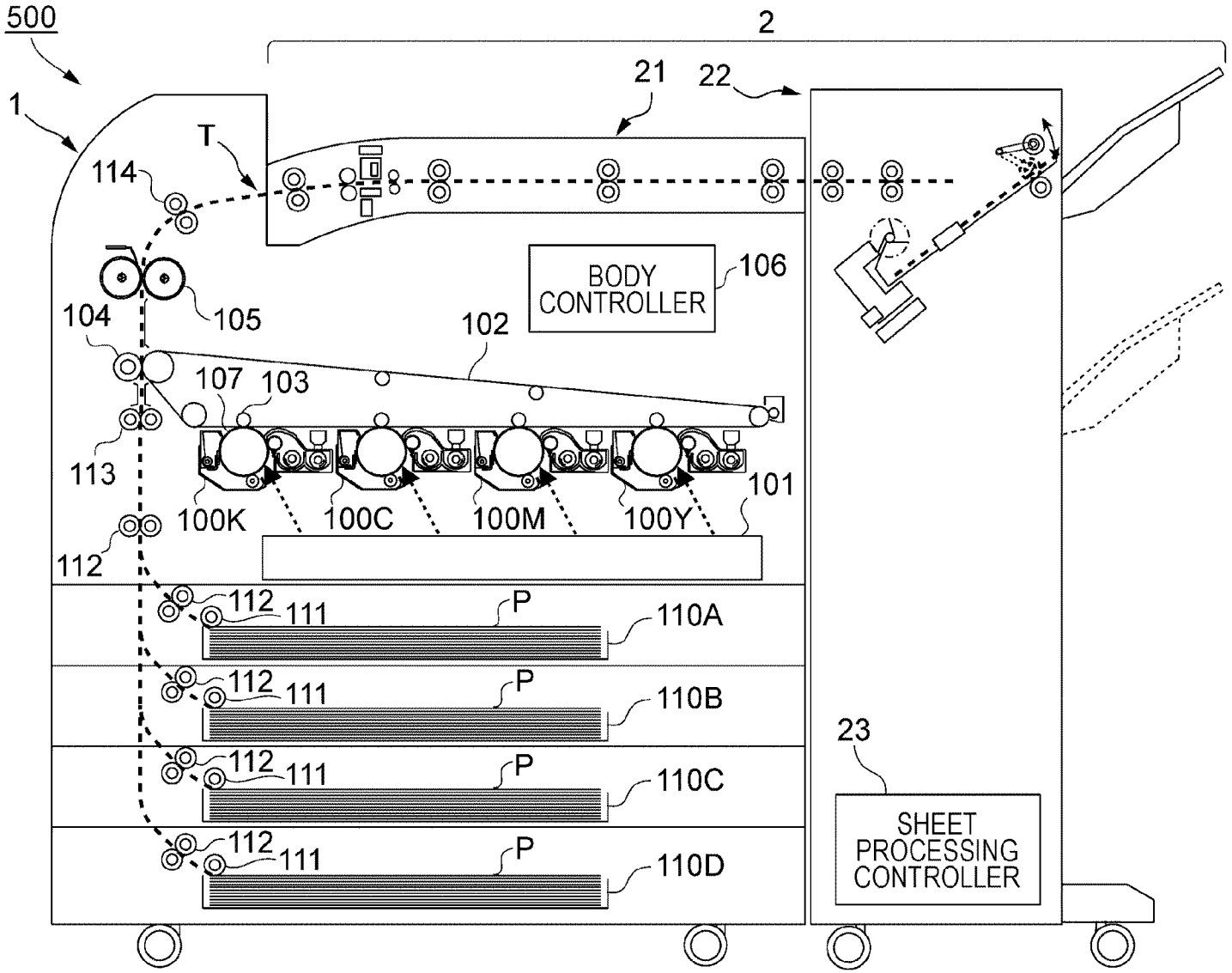
FIG. 1 illustrates the configuration of a recording material processing system to which a present exemplary embodiment is applied.

FIG. 1 illustrates the configuration of an image forming system 500 to which the present exemplary embodiment is applied.

The image forming system 500 illustrated in FIG. 1 includes an image forming device 1 that is a device such as a printer or a copier configured to form an image on a sheet P, which is an example of a recording material. The image forming system 500 also includes a post-processing device 2 that performs, for example, binding processing on plural sheets P (a bundle of sheets) on which images have been formed by the image forming device 1. Note that such a bundle of the sheets P is an example of a recording material bundle in the present exemplary embodiment.

The image forming device 1 includes four image forming units 100Y, 100M, 100C, and 100K, each of which is an example of an image forming portion. The four image forming units are also collectively referred to as image forming units 100. Each of the image forming units 100 forms an image based on image data of a corresponding color.

The image forming device 1 includes a laser exposure device 101 that exposes photoconductor drums 107 provided in the respective image forming units 100. The image forming device 1 includes an intermediate transfer belt 102 onto which toner images of the respective colors formed at the image forming units 100 are multi-transferred.

The image forming device 1 includes primary transfer rollers 103 that transfer the toner images of the respective colors formed at the image forming units 100 onto the intermediate transfer belt 102 one by one, a secondary transfer roller 104 that transfers simultaneously the toner images of the respective colors that have been transferred onto the intermediate transfer belt 102 onto a sheet P, and a fixing device 105 that fixes the secondarily transferred toner images of the respective colors on the sheet P. The image forming device 1 includes a body controller 106 that is constituted by a program-controlled central processing unit (CPU) and that controls an operation of the image forming device 1.

In each of the image forming units 100 of the image forming device 1, a toner image of the corresponding color is formed through a process of charging the photoconductor drum 107, a process of forming an electrostatic latent image on the photoconductor drum 107 due to scanning exposure performed by the laser exposure device 101, a process of developing the formed electrostatic latent image with the toner of the corresponding color, and other processes.

The toner images of the respective colors formed at the image forming units 100 are electrostatically transferred onto the intermediate transfer belt 102 by the primary transfer rollers 103. With the movement of the intermediate transfer belt 102, the toner images of the respective colors are transported to the position of the secondary transfer roller 104.

On the other hand, plural sheets P that differ in size and type are stored in respective sheet containers 110A to 110D in the image forming device 1.

When images are formed on sheets P, sheets P are picked up from, for example, the sheet container 110A by a pickup roller 111 and transported individually to the position of a resist roller 113 by transport rollers 112.

Each sheet P is fed by the resist roller 113 in accordance with a timing when the toner images of the respective colors on the intermediate transfer belt 102 are transported to the position of the secondary transfer roller 104.

Thus, the toner images of the respective colors are electrostatically transferred onto the sheet P simultaneously by the action of a transfer electric field formed by the secondary transfer roller 104.

Subsequently, the sheet P onto which the toner images of the respective colors have been secondarily transferred is separated from the intermediate transfer belt 102 and transported to the fixing device 105. The fixing device 105 performs fixing processing with heat and pressure to fix the toner images of the respective colors on the sheet P.

The sheet P that has passed through the fixing device 105 is discharged from a sheet discharge portion T of the image forming device 1 by a transport roller 114 and fed into the post-processing device 2.

The post-processing device 2, which is an example of a binding device, is disposed downstream of the sheet discharge portion T of the image forming device 1 and performs post-processing such as punching or binding with respect to the sheet P on which the image is formed.

Figure 2:
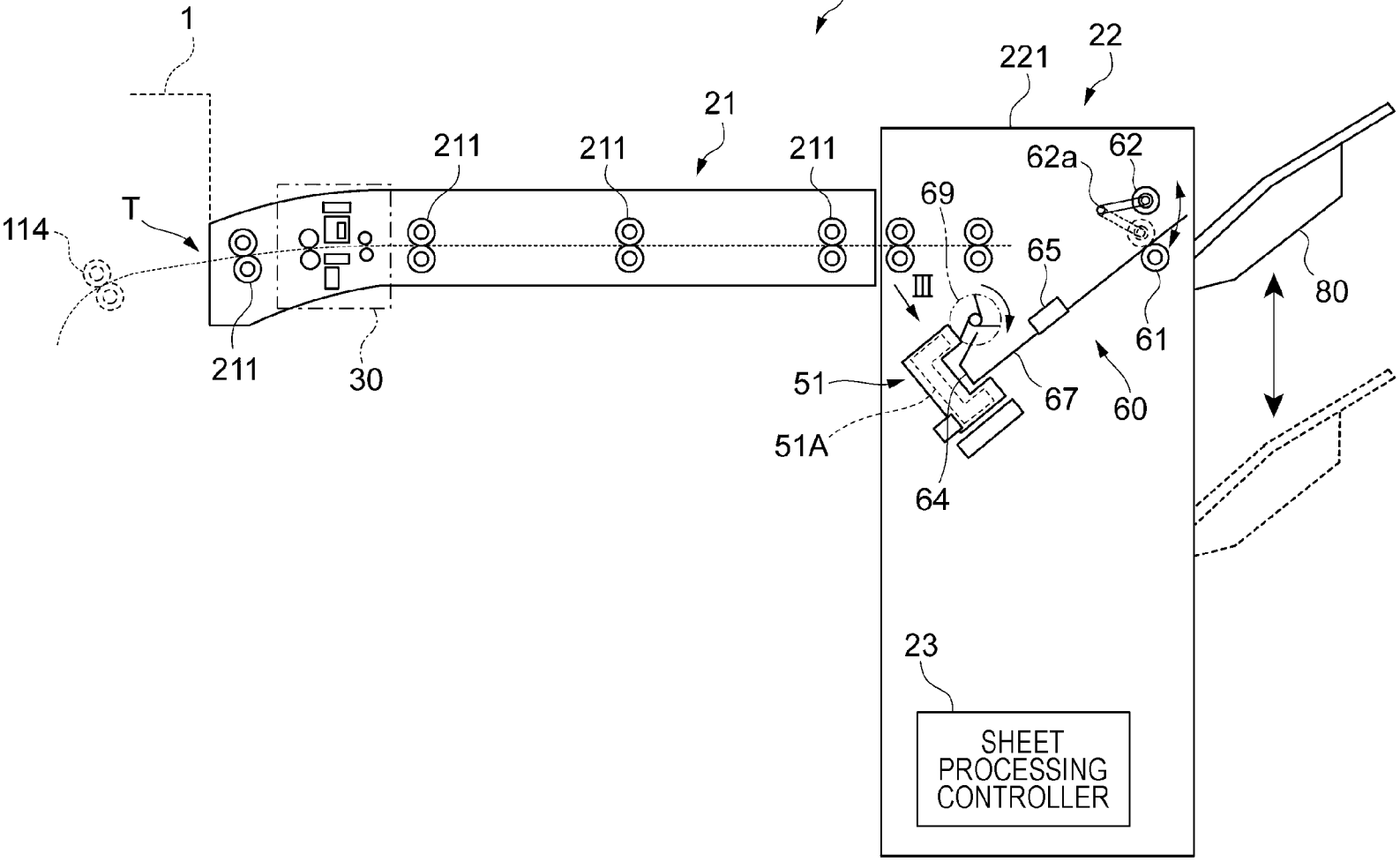
FIG. 2 illustrates the configuration of a post-processing device.

FIG. 2 illustrates the configuration of the post-processing device 2.

The post-processing device 2 includes a transport unit 21 connected to the sheet discharge portion T of the image forming device 1 and a finisher unit 22 that performs predetermined processing on the sheet P transported by the transport unit 21.

The post-processing device 2 also includes a sheet processing controller 23 constituted by a program-controlled CPU and configured to control each mechanism portion of the post-processing device 2. The sheet processing controller 23 and the body controller 106 are connected to one another via a signal line (not illustrated) and mutually transmit and receive, for example, control signals.

The transport unit 21 of the post-processing device 2 includes a punching function portion 30 that performs punching and plural transport rollers 211, each of which functions as a transport portion. The plural transport rollers 211 transport the sheet P on which an image has been formed at the image forming device 1 toward the finisher unit 22.

The finisher unit 22 includes a finisher unit body 221, a sheet collection portion 60 that collects a required number of sheets P to form a sheet bundle B, and a binding unit 51 that performs binding with respect to an end portion of the sheet bundle B formed at the sheet collection portion 60.

The finisher unit 22 also includes a transport roller 61 provided so as to rotate and used to transport the sheet bundle B formed at the sheet collection portion 60. A movable roller 62 is also provided so as to swing with a rotational shaft 62*a* as a movement center and so as to move to a position where the movable roller 62 is retracted from the transport roller 61 and to a position where the movable roller 62 comes into pressure contact with the transport roller 61.

There is also provided a stacker 80 on which the sheet bundles B transported by the transport roller 61 and the movable roller 62 are stacked. The stacker 80 moves up and down in accordance with the amount of sheet bundles B to be held.

When the post-processing device 2 performs processing, first, a sheet P is transported from the image forming device 1 in the transport unit 21 of the post-processing device 2.

In the transport unit 21, after being punched by the punching function portion 30, the sheet P is transported to the finisher unit 22 by the transport rollers 211. When no instruction for punching is provided, the sheet P is transported as it is to the finisher unit 22 without being punched by the punching function portion 30.

The sheet P that has been transported to the finisher unit 22 is transported to the sheet collection portion 60. Specifically, after being transported to a position above the sheet collection portion 60, the sheet P falls onto the sheet collection portion 60.

The sheet P is supported, from below, by a support plate 67 provided in the sheet collection portion 60. The sheet P slides over the support plate 67 due to an inclined shape that the support plate 67 has and by a rotating puddle 69.

Subsequently, the sheet P comes to abut against an end guide 64 attached to an end portion of the support plate 67. Thus, in the present exemplary embodiment, the sheet P stops moving.

Thereafter, such an operation is performed each time a sheet P is transported from the upstream side, and a sheet bundle B is formed on the sheet collection portion 60 with the trailing end portions of sheets P being aligned.

In the present exemplary embodiment, alignment members 65 are provided so as to move in the width direction of the sheet bundle B, that is, in a direction orthogonal to the plane of paper on which FIG. 2 is illustrated and align the positions of the sheets P of the sheet bundle B in the width direction of the sheet bundle B. Two alignment members 65 are provided: one alignment member 65 is disposed on one side in the width direction of the sheet bundle B, and the other alignment member 65 is disposed on the other side in the width direction of the sheet bundle B.

In the present exemplary embodiment, the end portions, in the width direction, of a sheet P are pushed by the alignment members 65 each time a sheet P is fed onto the support plate 67, and the positions of plural sheets P in the width direction thereof are aligned.

When a predetermined number of sheets P have been stacked on the support plate 67 to be formed into a sheet bundle B on the support plate 67, the binding unit 51 performs binding processing on an end portion of the sheet bundle B.

The binding unit 51 includes a binding member that presses a sheet bundle B. The binding member is constituted by an upper teeth portion disposed above a sheet bundle B to be formed and a lower teeth portion disposed below the sheet bundle B to be formed. The binding member, the upper teeth portion, and the lower teeth portion will be described in detail later.

In the present exemplary embodiment, there is also provided an advancing/retracting mechanism 51A that causes one of the upper teeth portion and the lower teeth portion to advance toward or retract from the other teeth portion.

In the present exemplary embodiment, when a sheet bundle B has been formed on the support plate 67, the sheet bundle B comes to be positioned between the upper teeth portion and the lower teeth portion. Subsequently, binding processing on the sheet bundle B is performed in a manner such that the upper teeth portion and the lower teeth portion press the sheet bundle B from both sides of the sheet bundle B and partially deform the sheet bundle B to pressure-bond the sheets constituting the sheet bundle B to one another. As described above, in the present exemplary embodiment, the binding processing on a sheet bundle B is performed without using a wire such as a staple.

When the binding processing on the sheet bundle B is finished, the movable roller 62 advances toward the transport roller 61, and the sheet bundle B is held between the movable roller 62 and the transport roller 61.

Subsequently, the transport roller 61 and the movable roller 62 rotate to drive the sheet bundle B, which has been subjected to the binding processing, onto the stacker 80.

Figure 3:
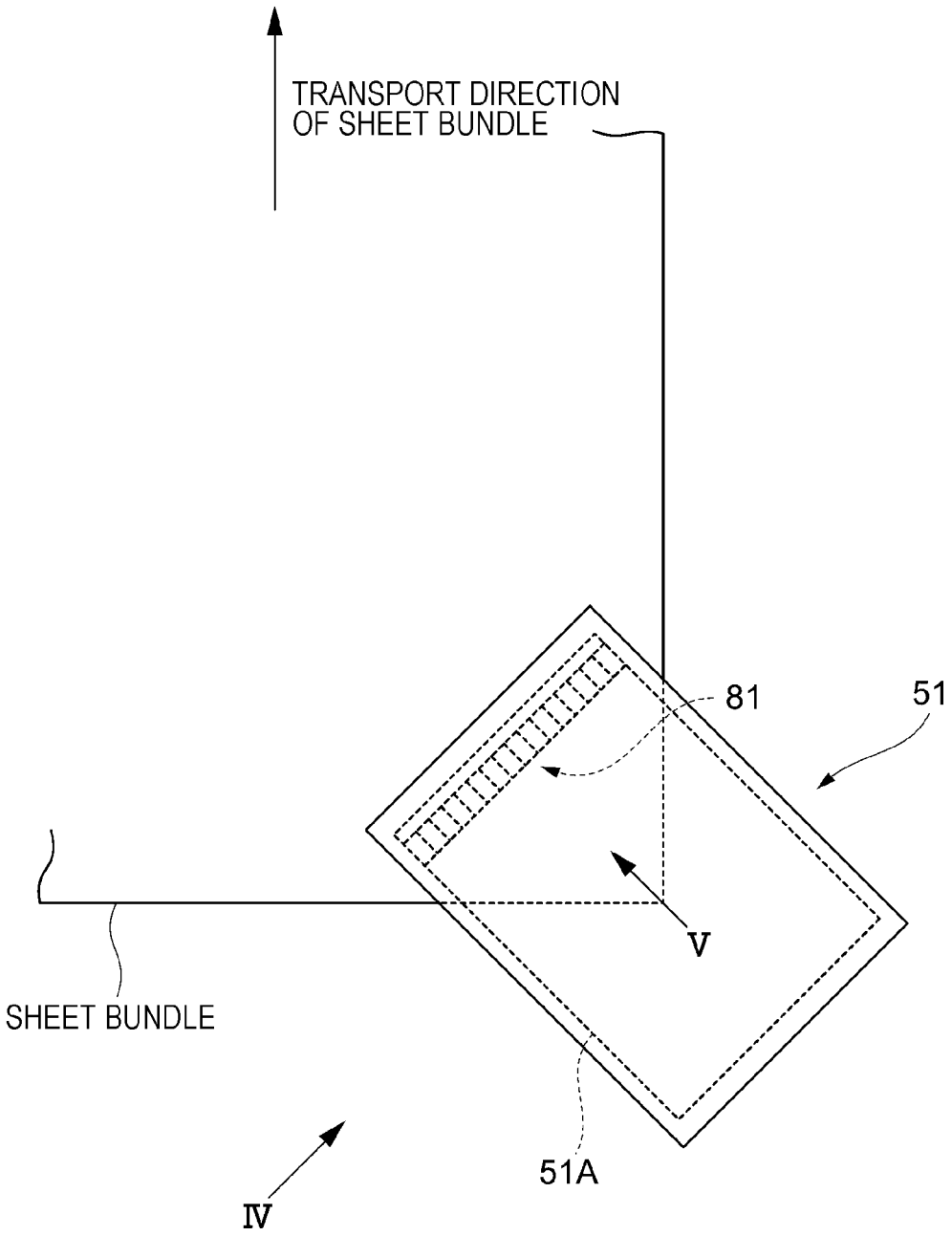
FIG. 3 illustrates a binding unit and a related part viewed in the direction of arrow III in FIG. 2.

FIG. 3 illustrates the binding unit 51 and a related part viewed in the direction of arrow III in FIG. 2.

In the present exemplary embodiment, as FIG. 3 illustrates, the binding unit 51 is disposed so as to be inclined with respect to the transport direction of a sheet bundle B. The binding unit 51 includes a binding member 81, and, in the present exemplary embodiment, the sheet bundle B is nipped and bound by the binding member 81.

In the present exemplary embodiment, the binding unit 51 is disposed so as to face a corner portion of the sheet bundle B to perform binding processing on the corner portion of the sheet bundle B.

Note that the above-described binding at the corner portion is an example of binding processing, and the binding unit 51 may be disposed so as to face a side of the sheet bundle B to perform binding processing on the side. In addition, the binding unit 51 may be movable to perform binding processing at plural positions of the sheet bundle B.

Figure 4A:
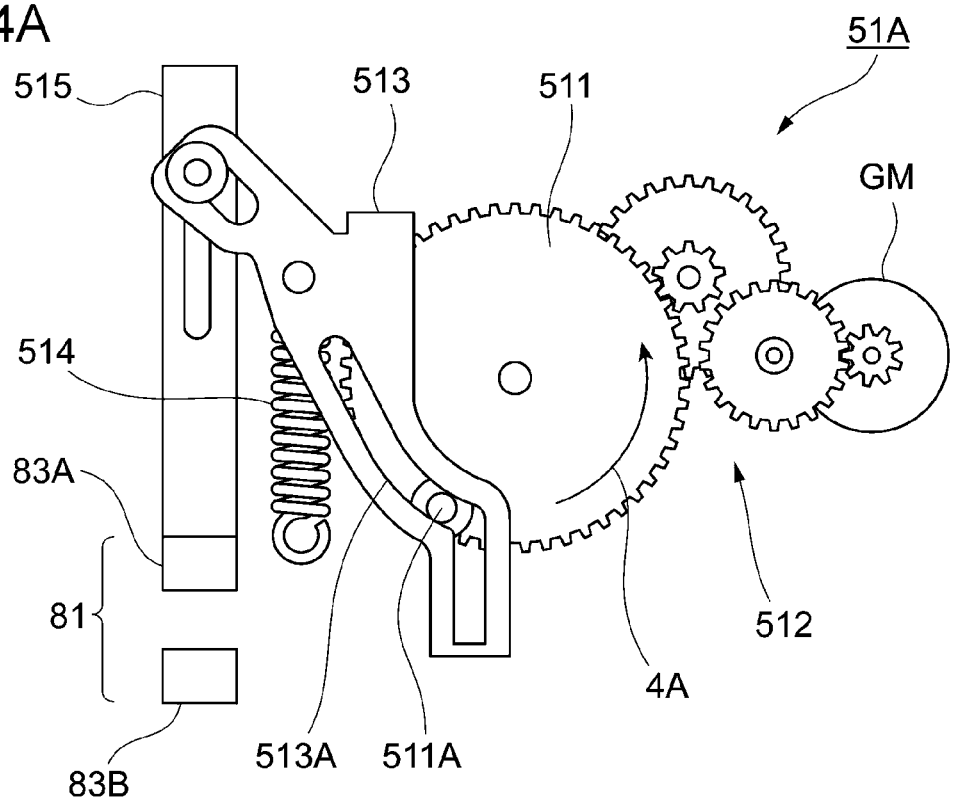
FIGS. 4A and 4B illustrate an advancing/retracting mechanism viewed in the direction of arrow IV in FIG. 3.
Figure 4B:
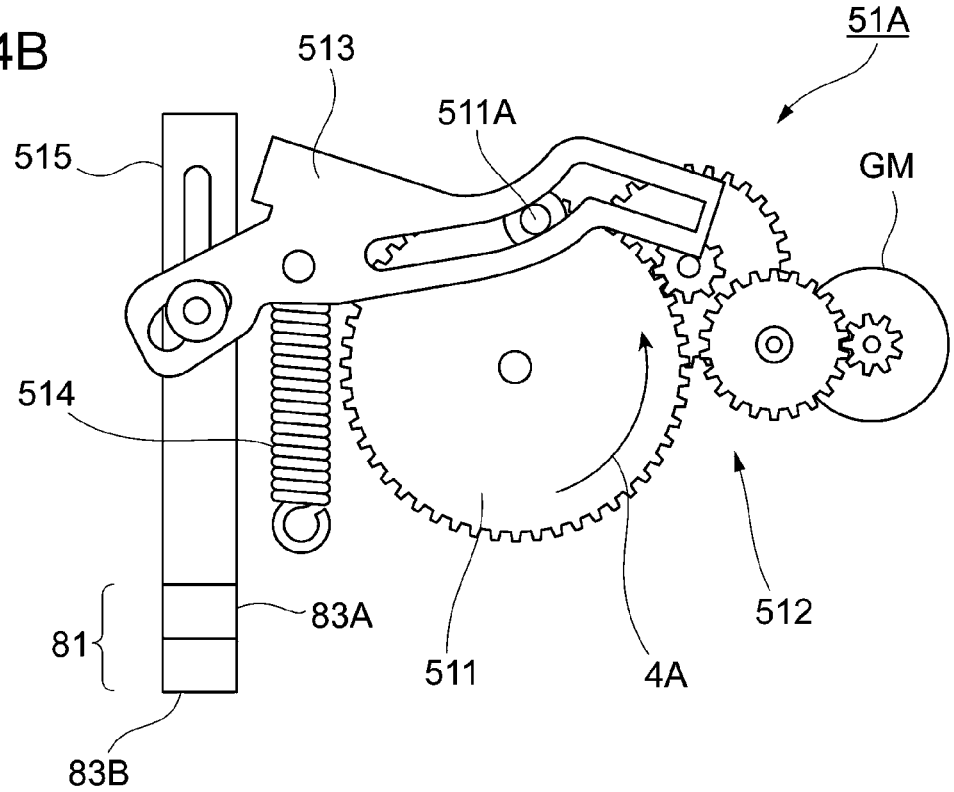

FIGS. 4A and 4B illustrate the advancing/retracting mechanism 51A viewed in the direction of arrow IV in FIG. 3.

As FIG. 4A illustrates, in the present exemplary embodiment, the binding member 81 that is driven by the advancing/retracting mechanism 51A to press a sheet bundle B is provided.

The binding member 81 is constituted by an upper teeth portion 83A and a lower teeth portion 83B that is positioned so as to face the upper teeth portion 83A. FIG. 4A illustrates a state where the upper teeth portion 83A have retracted from the lower teeth portion 83B.

As FIG. 4A illustrates, the advancing/retracting mechanism 51A includes a rotation gear 511, a gear motor GM, and a transmission gear 512 that transmits a driving force from the gear motor GM to the rotation gear 511. A crank member 513 is also provided so as to swing and has a long hole 513A in which a bump 511A provided on a side surface of the rotation gear 511 is positioned.

The advancing/retracting mechanism 51A also includes a spring 514 that urges the crank member 513 downward, and an advancing/retracting member 515 is attached to an end portion of the crank member 513 on the left side in FIG. 4A. In the present exemplary embodiment, the upper teeth portion 83A is attached to a lower end portion of the advancing/retracting member 515.

When binding processing is performed, the gear motor GM is driven, the rotation gear 511 is rotated in the direction of arrow 4A, and the bump 511A moves upward. While an end portion of the crank member 513 on the right side in FIG. 4A is raised upward, the end portion of the crank member 513 on the left side in FIG. 4A is pulled downward by the spring 514, and the advancing/retracting member 515 moves downward.

Thus, the upper teeth portion 83A advances toward the lower teeth portion 83B, and the advancing/retracting mechanism 51A is brought into the state illustrated in FIG. 4B.

By doing so, the upper teeth portion 83A and the lower teeth portion 83B press a sheet bundle B (not illustrated) from both sides in a layering direction of the sheets P in the sheet bundle B, the sheet bundle B is partially deformed, and the sheets P constituting the sheet bundle B are pressure-bonded to one another.

Subsequently, the upper teeth portion 83A is separated from the sheet bundle B, and it is thereby possible to remove the bound sheet bundle B from a region between the upper teeth portion 83A and the lower teeth portion 83B.

In the present exemplary embodiment, as described above, the binding processing on a sheet bundle B is performed by the upper teeth portion 83A moving in the up-and-down direction that is a predetermined advancing/retracting direction.

In the present exemplary embodiment, as described above, the rotation gear 511 and the crank member 513 move the upper teeth portion 83A so that the upper teeth portion 83A and the lower teeth portion 83B press the sheet bundle B and apply a predetermined load to the sheet bundle B to perform binding processing on the sheet bundle B.

The mechanism is an example of a load unit, and a load may be applied to a sheet bundle B by the upper teeth portion 83A being moved by a noncircular cam pressing the upper teeth portion 83A or pressing a portion that moves in conjunction with the upper teeth portion 83A. Alternatively, a load may be applied to a sheet bundle B by using another mechanism.

Figure 5A:
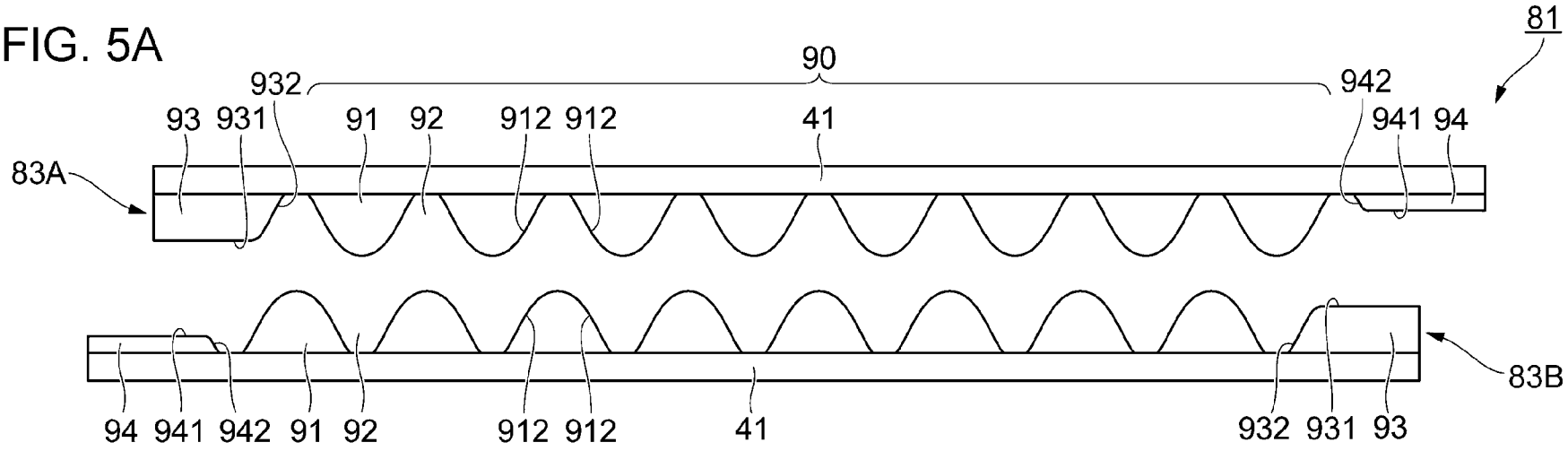
FIGS. 5A and 5B illustrate a binding member viewed in the direction of arrow V in FIG. 3.
Figure 5B:
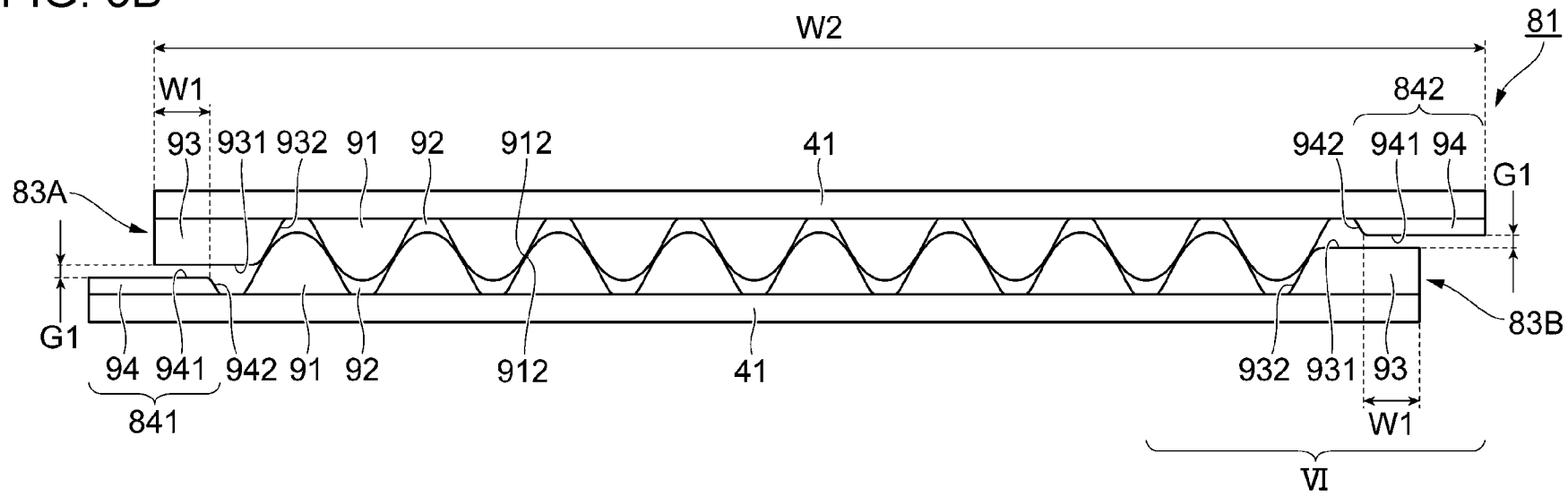

FIGS. 5A and 5B illustrate the binding member 81 viewed in the direction of arrow V in FIG. 3 and illustrate the sectional shape of the binding member 81.

As FIG. 5A illustrates, the binding member 81 is constituted by the upper teeth portion 83A and the lower teeth portion 83B that are two teeth portions facing one another. In the present exemplary embodiment, the upper teeth portion 83A and the lower teeth portion 83B have the same toothed shape, and the lower teeth portion 83B is formed by an upper teeth portion 83A being rotated by 180 degrees. Thus, the upper teeth portion 83A and the lower teeth portion 83B are produced by being molded with the same mold.

The upper teeth portion 83A and the lower teeth portion 83B include respective base portions 41 extending in the right-and-left direction in FIG. 5A. The mutually opposing faces of the base portions 41 of the upper teeth portion 83A and the lower teeth portion 83B have respective teeth rows 90 for forming unevenness in a sheet bundle B.

The teeth row 90 of each of the upper teeth portion 83A and the lower teeth portion 83B is constituted by plural projecting portions 91 arranged side by side in the longitudinal direction of the base portion 41 and plural recessed portions 92 arranged side by side in the longitudinal direction of the base portion 41.

The projecting portions 91 of the upper teeth portion 83A protrude from a surface of the base portion 41 toward the lower teeth portion 83B. On the other hand, the projecting portions 91 of the lower teeth portion 83B protrude from a surface of the base portion 41 toward the upper teeth portion 83A. Each of the recessed portions 92 is disposed between two adjacent projecting portions 91. Thus, in the longitudinal direction of the base portion 41, the projecting portions 91 and the recessed portions 92 are arranged alternately.

The width of each projecting portion 91 and each recessed portion 92 is predetermined, and the width here is a dimension in a direction intersecting a direction where the teeth in the teeth row 90 are arranged side by side and intersecting a direction where the projecting portions 91 protrude.

Here, each of the projecting portions 91 of the upper teeth portion 83A and the lower teeth portion 83B has inclined portions 912.

The inclined portions 912 constitute, in a chevron-shaped section, both faces of each of the projecting portions 91 provided in the upper teeth portion 83A and the lower teeth portion 83B. More specifically, each of the inclined portions 912 is formed in a portion of an outer surface of the projecting portion 91, the portion diagonally extending from a top portion of the projecting portion 91 toward a trough portion of the recessed portion 92.

Regarding each of the upper teeth portion 83A and the lower teeth portion 83B, a first protrusion 93 and a second protrusion 94 are provided at both ends of the teeth row 90 and are adjacent to the teeth row 90.

The first protrusion 93 and the second protrusion 94 protrude in a protruding direction where the projecting portions 91 protrude, and respectively have a first top portion 931 and a second top portion 941 at respective distal ends in the protruding direction. In the present exemplary embodiment, at least a portion of each of the top portions 931 and 941 has a face parallel to the base portion 41. The face parallel to the base portion 41 may have a planar shape.

As FIG. 5A illustrates, the first top portion 931 of the upper teeth portion 83A and the second top portion 941 of the lower teeth portion 83B face one another and are substantially parallel to one another. Similarly, the second top portion 941 of the upper teeth portion 83A and the first top portion 931 of the lower teeth portion 83B face one another and are substantially parallel to one another.

Here, in the present exemplary embodiment, the heights of the first protrusion 93 and the second protrusion 94 in a direction where the protrusions 93 and 94 protrude from the base portion 41 are lower than the heights of the projecting portions 91. More specifically, the protrusions 93 and 94 are greater in height than the base portion 41 and lower in height than the top portions of the projecting portions 91.

In the present exemplary embodiment, the height of the first protrusion 93 in the direction where the protrusion 93 protrudes from the base portion 41 is greater than the height of the second protrusion 94 in the direction where the protrusion 94 protrudes from the base portion 41. However, as an alternative form, the height of the first protrusion 93 in the direction where the protrusion 93 protrudes from the base portion 41 may be equal to the height of the second protrusion 94 in the direction where the protrusion 94 protrudes from the base portion 41.

The first protrusion 93 and the second protrusion 94 have inclined portions 932 and 942, respectively.

The inclined portion 932 is formed in a face of the first protrusion 93 on the teeth row 90 side. More specifically, the inclined portion 932 is formed in a portion of an outer surface of the section of the first protrusion 93, the portion diagonally extending from the top portion 931 toward the trough portion of the adjacent recessed portion 92. Similarly, the inclined portion 942 is formed in a face of the second protrusion 94 on the teeth row 90 side.

FIG. 5B illustrates a state where the upper teeth portion 83A and the lower teeth portion 83B are butted against one another without holding a sheet bundle B therebetween.

In such a state, in the present exemplary embodiment, the teeth row 90 of the upper teeth portion 83A and the teeth row 90 of the lower teeth portion 83B mesh with one another, and, between each of the inclined portions 912 of the upper teeth portion 83A and the corresponding inclined portion 912 of the lower teeth portion 83B, a region where the inclined portions 912 are in contact with one another is formed.

In addition, between the inclined portion 932 of the first protrusion 93 of the upper teeth portion 83A and the corresponding inclined portion 912 of the lower teeth portion 83B, a region where the inclined portion 932 and the inclined portion 912 are in contact with one another is formed. Similarly, between the inclined portion 932 of the first protrusion 93 of the lower teeth portion 83B and the corresponding inclined portion 912 of the upper teeth portion 83A, a region where the inclined portion 932 and the inclined portion 912 are in contact with one another is formed.

As described above, by corresponding ones of the inclined portions being in contact with one another, stress applied from each inclined portion to a sheet bundle B in the layering direction of the sheets P, at the time of binding processing, increases, compared with a case where corresponding ones of the inclined portions are not in contact with one another.

Thus, in the present exemplary embodiment, a binding function may increase compared with the case where corresponding ones of the inclined portions are not in contact with one another.

In addition, as FIG. 5B illustrates, when the upper teeth portion 83A and the lower teeth portion 83B are butted against one another, the top portion 931 of each of the first protrusions 93 and the top portion 941 of the corresponding second protrusion 94 do not come into contact with one another, and a gap G1 is thereby formed. In the present exemplary embodiment, a sheet bundle B is held in the gap G1, and, at both ends of each of the teeth rows 90, a holding portion at one end is a first holding portion 841, and a holding portion at the other end is a second holding portion 842.

More specifically, the first holding portion 841 is constituted by the first top portion 931 of the upper teeth portion 83A and the second top portion 941 of the lower teeth portion 83B. Similarly, the second holding portion 842 is constituted by the second top portion 941 of the upper teeth portion 83A and the first top portion 931 of the lower teeth portion 83B. A holding function of each of the first and second holding portions 841 and 842 will be described in detail later.

Figure 6A:
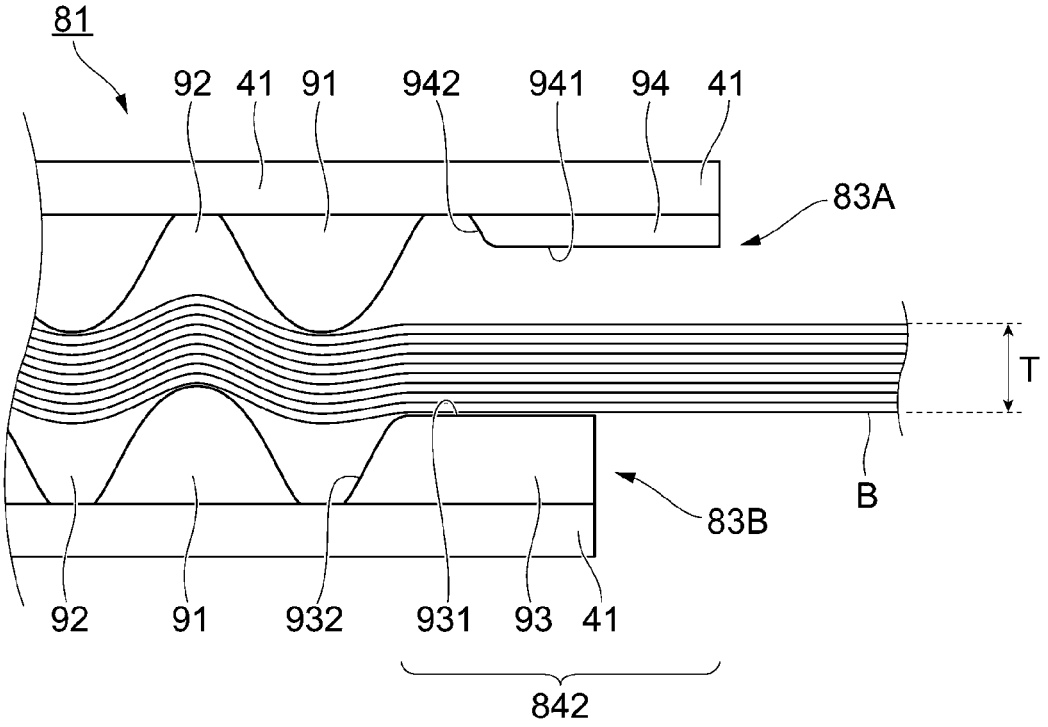
FIGS. 6A and 6B are magnified views of the part VI in FIG. 5B when a sheet bundle is held between an upper teeth portion and a lower teeth portion, that is.
Figure 6B:
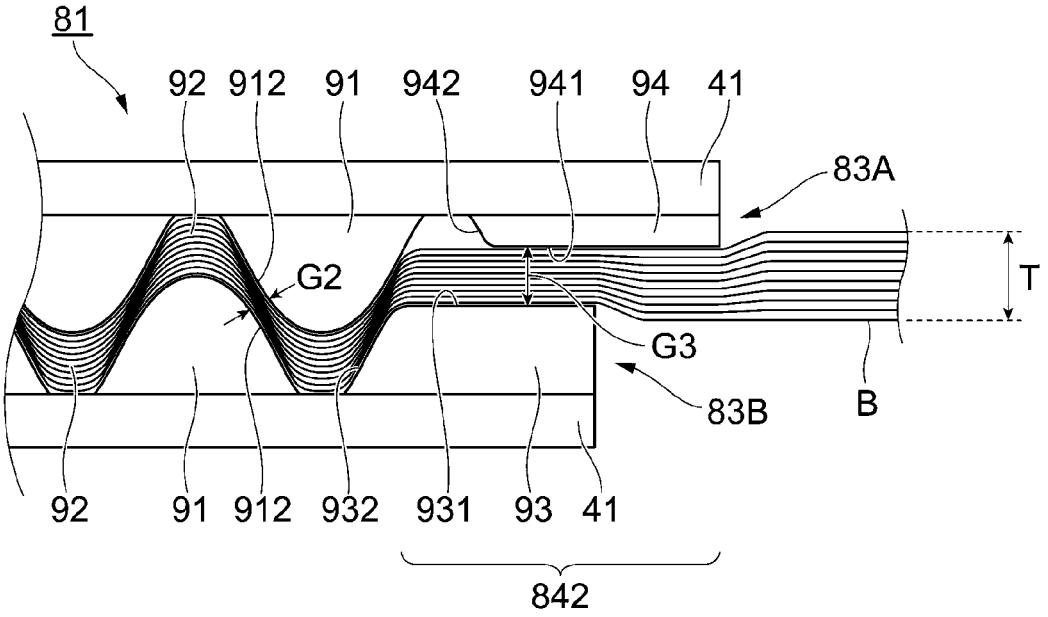

FIGS. 6A and 6B illustrate a state of the binding member 81 when binding processing is performed on a sheet bundle B. Here, the part indicated by VI in FIG. 5B is magnified. FIG. 6A illustrates a state where, in the binding processing, pressing is started, and FIG. 6B illustrates a state where the pressing in the binding processing is finished. The sheet bundle B is constituted by plural, approximately ten, sheets suitable for copying or printing.

First, when the binding processing on a sheet bundle B is performed, the advancing/retracting mechanism illustrated in FIGS. 4A and 4B causes the upper teeth portion 83A to advance toward the lower teeth portion 83B with the sheet bundle B being positioned between the upper teeth portion 83A and the lower teeth portion 83B.

When the upper teeth portion 83A advances, as FIG. 6A illustrates, the upper teeth portion 83A comes to press one face of the sheet bundle B, and the lower teeth portion 83B comes to press the other face of the sheet bundle B.

When the upper teeth portion 83A further advances only by a predetermined amount, as FIG. 6B illustrates, the upper teeth portion 83A and the lower teeth portion 83B approach one another even more closely to bring the sheet bundle B into a state of being pressed hardest by the upper teeth portion 83A and the lower teeth portion 83B. At this time, a predetermined load is applied to the sheet bundle B. On this occasion, the projecting portions 91 of the upper teeth portion 83A enter respective regions between the projecting portions 91 of the lower teeth portion 83B.

Subsequently, the upper teeth portion 83A retracts from the sheet bundle B, and it is thereby possible to remove the bound sheet bundle B. Eventually, the binding processing on the sheet bundle B is completed.

When the binding processing on the sheet bundle B is completed, a portion of the sheet bundle B nipped by the binding member 81 is deformed to have an uneven shape in accordance with the shapes of portions of the upper teeth portion 83A and the lower teeth portion 83B having a binding function, and a bound portion is formed. At the bound portion, the sheets P constituting the sheet bundle B are pressure-bonded to one another.

At the time of the binding processing, when being held between and pressed by the upper teeth portion 83A and the lower teeth portion 83B, the sheet bundle B is compressed in the layering direction of the sheets P. On this occasion, the sheet bundle B is deformed to have an uneven shape in accordance with the shapes of the projections and recesses constituted by the teeth rows 90 of the upper teeth portion 83A and the lower teeth portion 83B, and the sheet bundle B is compacted. At this time, a sheet P may be broken at such a deformed portion.

As FIG. 6B illustrates, in the present exemplary embodiment, there is a minimum gap G2 between the inclined portion 912 of the upper teeth portion 83A and the corresponding inclined portion 912 of the lower teeth portion 83B in the state where the sheet bundle B is pressed hardest. In such a state, in the present exemplary embodiment, the maximum stress to be applied to the sheet bundle B by the teeth rows 90 of the upper teeth portion 83A and the lower teeth portion 83B is generated at each gap G2.

At the minimum gap G2, the sheet bundle B is compressed hardest in the layering direction of the sheets P. For example, in the present exemplary embodiment, the sheet bundle B is compressed at the gap G2 to have a thickness of 20% of an original thickness T.

In addition, at the time of the binding processing on the sheet bundle B, when the upper teeth portion 83A advances, the protrusions 93 and 94 of the upper teeth portion 83A approach the sheet bundle B. When the upper teeth portion 83A further advances, the holding portions 841 and 842 come into contact with surfaces of the sheet bundle B.

Subsequently, when the upper teeth portion 83A further advances, the holding portions 841 and 842 come to press the sheet bundle B. Thus, the sheet bundle B starts being compressed in the layering direction of the sheets P at the holding portions 841 and 842.

When the upper teeth portion 83A then advances by a predetermined amount, as FIG. 6B illustrates, at the holding portion 842, the top portion 931 of the protrusion 93 and the top portion 941 of the protrusion 94 approach one another even more closely to cause a gap therebetween to become a gap G3. Similarly, at the holding portion 841 illustrated in FIG. 5B, the top portion 931 of the protrusion 93 and the top portion 941 of the protrusion 94 approach one another even more closely to cause a gap therebetween to become a gap G3.

In such a state, the maximum stress to be applied to the sheet bundle B by the holding portions 841 and 842 is generated at each gap G3.

In the binding processing, when the holding portions 841 and 842 come into contact with and start pressing the sheet bundle B, the sheet bundle B comes to be held at the holding portions 841 and 842. The sheets P constituting the sheet bundle B may be suppressed from being deformed and broken at the holding portions 841 and 842.

As described above, the holding portions 841 and 842 according to the present exemplary embodiment hold the sheet bundle B at positions different from the positions of portions having the binding function.

At the time of the binding processing, when a portion of the sheet bundle B to be deformed is broken, a force to shift or incline a tooth is generated. At this time, in a case of having no holding portions 841 and 842, a binding force may significantly decrease because, with such breakage, the tooth is shifted or inclined toward a broken portion.

In the present exemplary embodiment, because the sheet bundle B is held by the holding portions 841 and 842, the upper teeth portion 83A and the lower teeth portion 83B may be suppressed from being shifted or inclined.

Here, the gap G3 between the protrusion 93 and the protrusion 94 constituting a corresponding one of the holding portions 841 and 842 will be described in detail.

In the binding member 81, the gap G3 has a thickness smaller than the original thickness T of a sheet bundle B, and the sheet bundle B is thereby compressed to have a thickness smaller than the original thickness T. In the gap G3, the sheet bundle B is compressed to have a thickness of, for example, 50% of the original thickness T and held therein.

In the binding member 81, the gap G3 is larger than the above-described gap G2. When the gap G3 is excessively smaller than the gap G2, the maximum stress applied to the sheet bundle B by the teeth rows 90 decreases, and the binding function is thereby reduced significantly.

Figure 7:
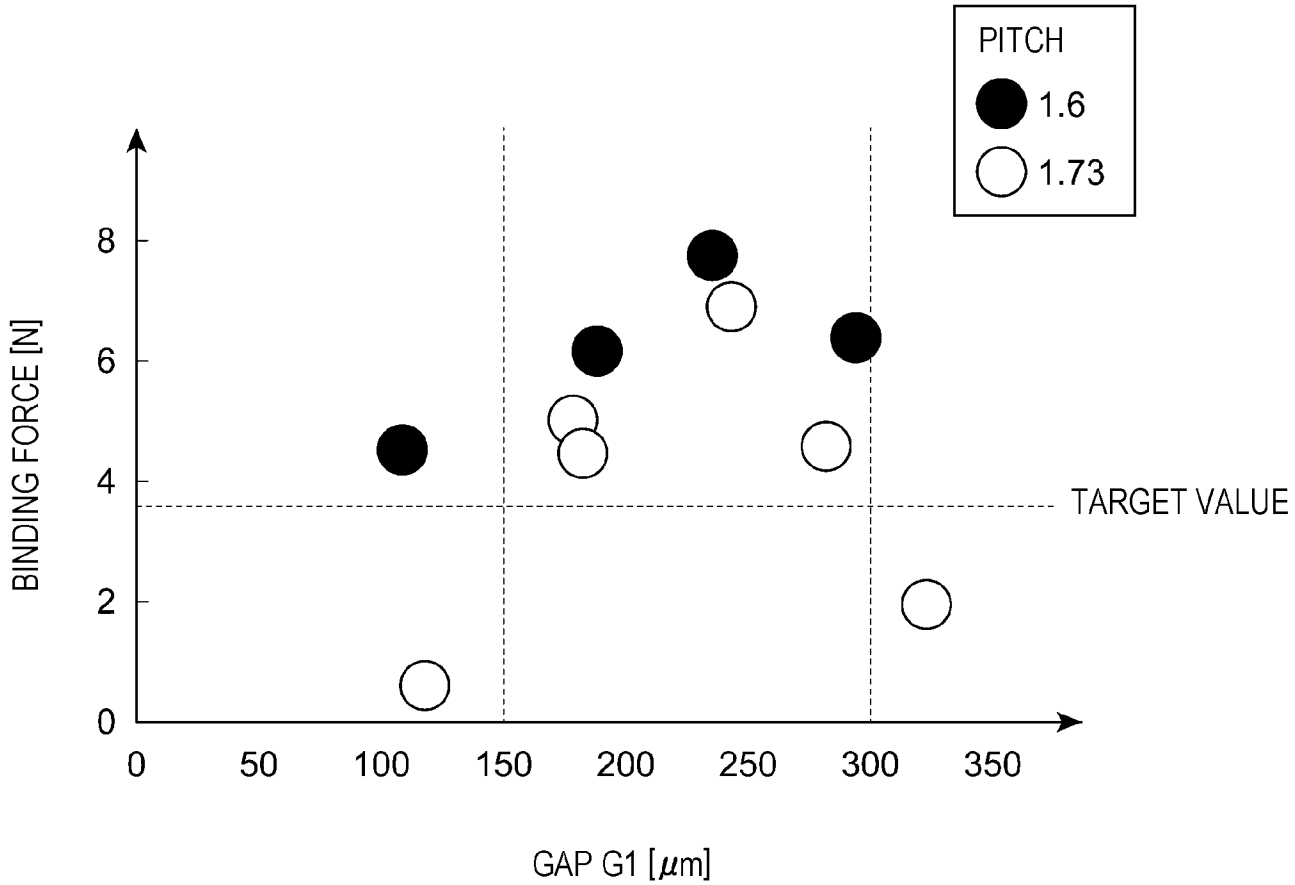
FIG. 7 is a graph of the relationship between a gap of a holding portion and a binding force.

FIG. 7 illustrates the relationship between the gap of each of the holding portions 841 and 842 when the upper teeth portion 83A and the lower teeth portion 83B are butted against one another and a binding force. The horizontal axis of the graph represents the gap G1 between the first protrusion 93 and the second protrusion 94 in a state where the upper teeth portion 83A and the lower teeth portion 83B are butted against one another without interposing the sheet bundle B therebetween, and the vertical axis represents the binding force. Here, the results in a case where a pitch is 1.6 mm and in a case of 1.73 mm are given. The pitch is a gap between the adjacent projecting portions 91 of each of the upper teeth portion 83A and the lower teeth portion 83B. The broken line represents a target value of the binding force.

When the gap G1 of each of the holding portions 841 and 842 is 150 μm to 300 μm, as FIG. 7 illustrates, the binding force notably increases to exceed the target value in the case where the pitch is 1.6 mm and in the case of 1.73 mm.

Here, when a sheet bundle B is interposed, the gap of each of the holding portions 841 and 842 becomes the gap G3. When the gap G1 is 150 μm to 300 μm and if the minimum gap G2 when the sheet bundle B is interposed and a load is applied thereto is 200 μm, the gap G3 is 350 μm to 500 μm. That is, when the binding force exceeding the target value is intended to be obtained, the gap G3 is 1.7 to 2.5 times as large as the gap G2. The gap G3 is 1.7 to 2.5 times as large as the gap G2, and a reliable binding function may thereby be obtained.

At the time of the binding processing, when a force to shift or incline a tooth is generated, a frictional force is generated between each of the holding portions 841 and 842 and the surfaces of the sheet bundle B. Because the force to cause such shift or inclination is applied in a direction opposite to a direction where the frictional force is applied, a tooth is more suppressed from being shifted or inclined as the frictional force increases.

In the present exemplary embodiment, such a frictional force is increased by adjusting a surface roughness Ra of each of the holding portions 841 and 842. The surface roughness Ra is a roughness of an arithmetic mean defined by Japanese Industrial Standard (JIS) B 0601.

Figure 8:
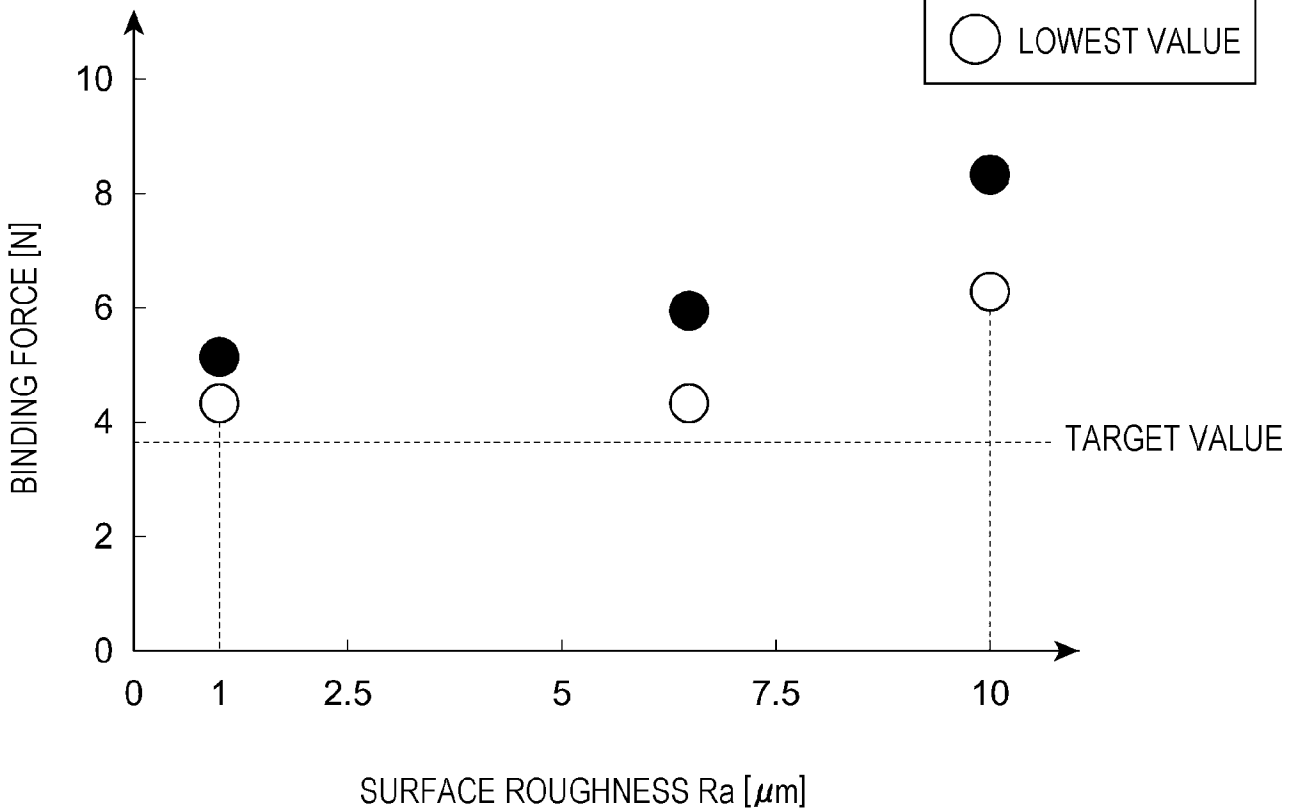
FIG. 8 is a graph of the relationship between the surface roughness of a top portion of a protrusion and a binding force.

FIG. 8 illustrates the relationship between the surface roughness of each of the holding portions 841 and 842 and a binding force. The horizontal axis of the graph represents the surface roughness Ra of each of the top portions 931 and the top portions 941 constituting the holding portions 841 and 842, and the vertical axis represents the binding force. The graph gives mean values and lowest values, each of which is obtained by measuring plural times. The broken line represents a target value of the binding force.

When the surface roughness of each of the top portions 931 and 941 is Ra1 μm to Ra10 μm, as FIG. 8 illustrates, each of the mean values and the lowest values of the binding force exceeds the target value.

Here, because decreasing as the surface roughness decreases, the binding force may fall below the target value if the surface roughness is below Ra1 μm. In contrast, when the surface roughness exceeds Ra10 μm and becomes excessively large, a surface of a sheet P may be damaged due to such a surface roughness, and the binding force may thereby decrease. Thus, a reliable binding function may stably be obtained by setting the surface roughness of each of the top portions 931 and 941 to Ra1 μm to Ra10 μm.

At the time of the binding processing, the stress applied to a sheet bundle B by the holding portions 841 and 842 is determined by a width W1 (refer to FIG. 5B) of a region where the top portion 931 and the top portion 941 face one another.

As the width W1 is increased, the load received by the holding portions 841 and 842 increases during application of the load performed by the advancing/retracting mechanism 51A; however, on the other hand, the load received by the teeth rows 90 decreases, and the stress applied to the sheet bundle B by the teeth rows 90 thereby decreases to reduce the binding function.

Thus, to obtain a reliable binding function with a limited load, it may be desirable not to excessively increase the width W1. For example, when the maximum stress applied to the sheet bundle B by the holding portions 841 and 842 is smaller than the maximum stress applied by the teeth rows 90, a more reliable binding function may be obtained compared with a case where the binding member 81 is configured differently from that of the above-described case.

Figure 9:
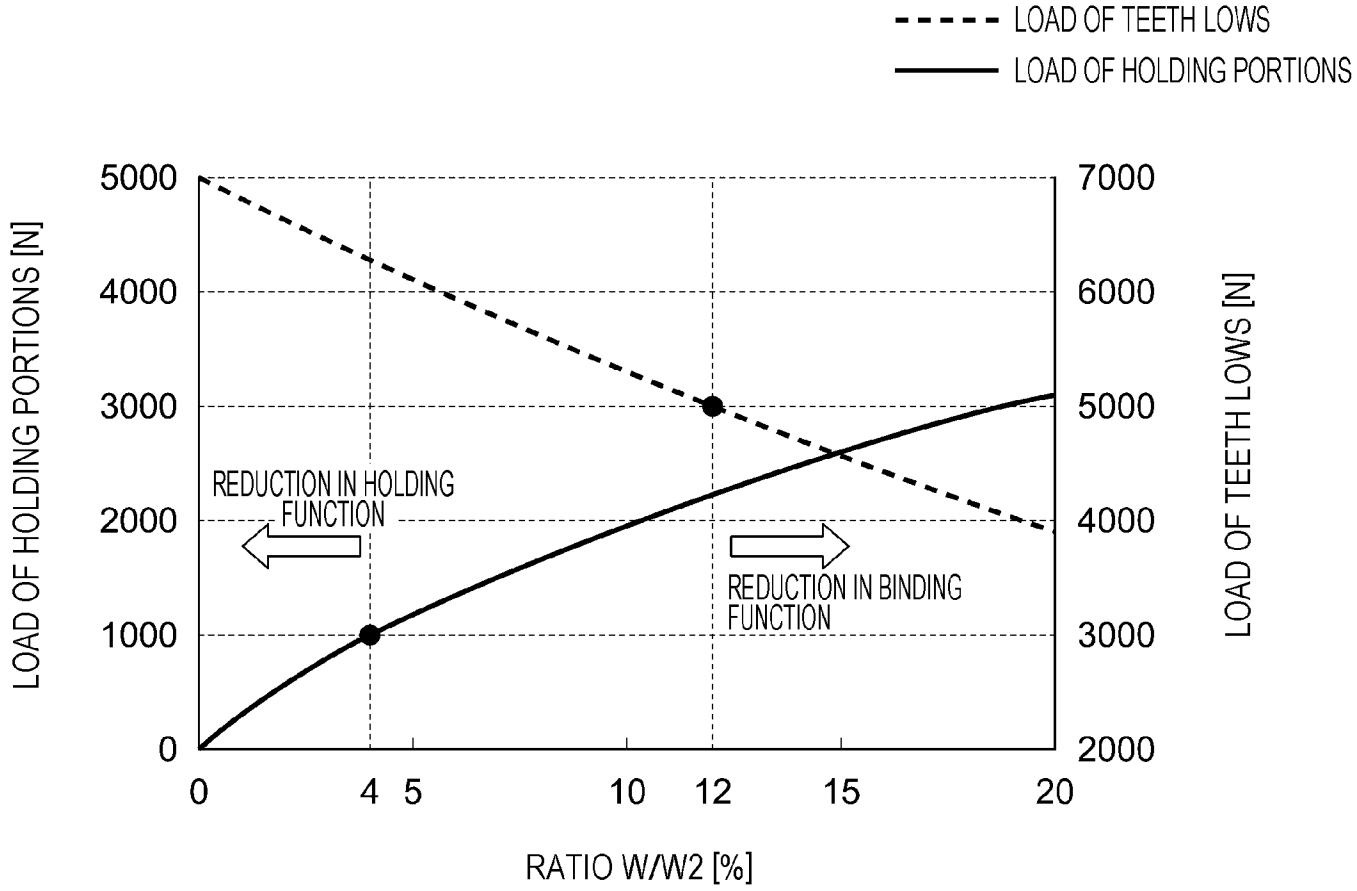
FIG. 9 is a graph of the relationship between the ratio regarding the width of protrusion, the load received by the protrusions, and the load received by teeth rows.

FIG. 9 illustrates the relationship between the ratio regarding a width W of each teeth portion, the load received by the holding portions 841 and 842, and the load received by the teeth rows 90. The width W is the sum of the width W1 of a region where the top portion 931 and the top portion 941 face one another at the holding portion 841 and the width W1 of such a facing region at the holding portion 842.

The horizontal axis of FIG. 9 represents the ratio W/W2 of the width W to the width W2 of the teeth portion (refer to FIG. 5B) on a percentage basis. The width W2 of the teeth portion is the sum of the widths of the protrusions 93 and 94 and the width of the teeth row 90. The vertical axis on the left side of FIG. 9 represents the load received by the holding portions 841 and 842 during application of the load, and the second vertical axis on the right side of FIG. 9 represents the load received by the teeth rows 90. The solid line represents the load of the holding portions 841 and 842 in accordance with changes in the ratio W/W2, and the broken line represents the load of the teeth rows 90 in accordance with the changes in the ratio W/W2.

As FIG. 9 illustrates, as the ratio W/W2 increases, the load received by the holding portions 841 and 842 increases whereas the load received by the teeth rows 90 decreases. Due to such a relationship, in the present exemplary embodiment, the binding member 81 is configured so that the ratio W/W2 is 4% to 12%. When the ratio W/W2 falls below 4% to cause the load received by the holding portions 841 and 842 to be excessively small, the maximum stress applied to the sheet bundle B by the holding portions 841 and 842 decreases to significantly reduce the holding function. In addition, when the ratio W/W2 exceeds 12% to cause the load received by the teeth rows 90 to be excessively small, the maximum stress applied to the sheet bundle B by the teeth rows 90 decreases to significantly reduce the binding function.

In the above-described exemplary embodiment, the width W2 is calculated without distinguishing the width W2 of the upper teeth portion 83A from that of the lower teeth portion 83B because the upper teeth portion 83A and the lower teeth portion 83B have the same shape. In another exemplary embodiment, when an upper teeth portion 83A and a lower teeth portion 83B have different widths, the width smaller than the other width is a width W2, and the teeth portion having the width W2 is configured so that the ratio W/W2 is 4% to 12%.

In the above-described exemplary embodiment, the maximum stress applied to the sheet bundle B by the holding portions 841 and 842 is smaller than the maximum stress applied to the sheet bundle B by the teeth rows 90. Thus, the binding function may be suppressed from being significantly reduced.

Moreover, in the above-described exemplary embodiment, the maximum stress applied to the sheet bundle B by the holding portions 841 and 842 is smaller than or equal to half the maximum stress applied to the sheet bundle B by the teeth rows 90. With such a configuration, the sheet bundle B may be suppressed from being excessively compressed and from being deformed or broken at the holding portions 841 and 842.

In the above-described exemplary embodiment, the maximum stress applied to the sheet bundle B by the holding portions 841 and 842 may be suppressed from becoming excessively large by adjusting the gap G3 and the width W1 of the facing region at each of the holding portions 841 and 842. However, a configuration for suppressing the maximum stress at the holding portions 841 and 842 from becoming excessively large is not limited to the above-described configuration.

For example, in the present exemplary embodiment, the width of each of the protrusions 93 and 94 in a direction where each of the projecting portions 91 and the recessed portions 92 extends may be larger than or equal to double the width of each of the projecting portion 91 and the recessed portion 92 in the direction where the projecting portion 91 and the recessed portion 92 extend. In such a configuration, the maximum stress applied to a sheet bundle B by the holding portions 841 and 842 also decreases to be smaller or equal to half the maximum stress applied to the sheet bundle B by the teeth rows 90.

In a case where binding processing is performed by partially deforming a sheet bundle B, sheets P are usually deformed at portions with which the teeth row of the binding member comes into contact, and the visibility of the images formed on such portions is thereby reduced. In the present exemplary embodiment, by providing the holding portions 841 and 842 at both ends, the portions to be deformed by the teeth rows 90 are brought closely together into a region, and the visibility of the images formed on the sheets P may be suppressed from being reduced.

Second Exemplary Embodiment

Figure 10:
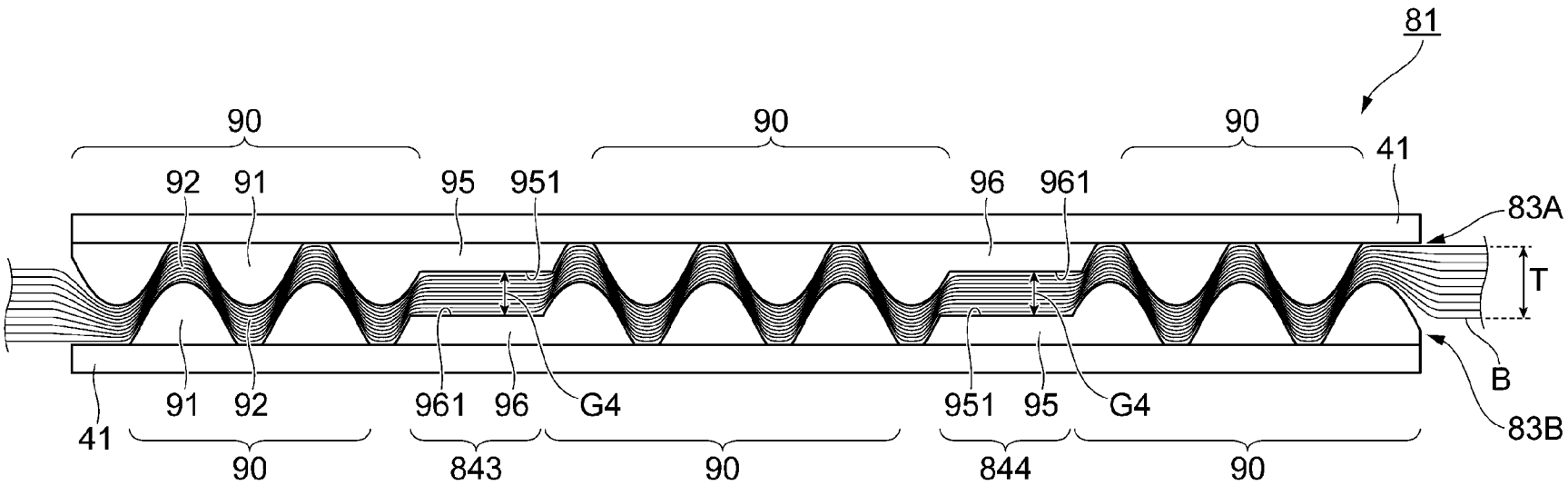
FIG. 10 illustrates a binding member having holding portions at two positions between teeth rows.

FIG. 10 illustrates a binding member 81 according to a second exemplary embodiment. In the above-described first exemplary embodiment, the holding portions 841 and 842 are disposed at both ends of each of the teeth rows 90. A feature of the second exemplary embodiment is a holding portion disposed between teeth rows 90. Note that, in the second exemplary embodiment, constituents similar to those of the first exemplary embodiment are denoted by the same references, and the detailed description of the constituents will be omitted.

In the present exemplary embodiment illustrated in FIG. 10, regarding each of an upper teeth portion 83A and a lower teeth portion 83B, a first protrusion 95 and a second protrusion 96 are arranged at two respective positions, each of which is between corresponding ones of the teeth rows 90. As a result, each of the upper teeth portion 83A and the lower teeth portion 83B has the teeth rows 90 at three positions, and each of the protrusions 95 and 96 is disposed between corresponding ones of the teeth rows 90.

The protrusion 95 protrudes in a protruding direction where projecting portions 91 protrude and has a top portion 951 at the distal end thereof in the protruding direction. Similarly, the protrusion 96 protrudes in the protruding direction where the projecting portions 91 protrude and has a top portion 961 at the distal end thereof in the protruding direction.

As FIG. 10 illustrates, the top portion 951 of the upper teeth portion 83A and the top portion 961 of the lower teeth portion 83B face one another and constituted by planes substantially parallel to one another. The top portion 951 and the top portion 961 constitute a holding portion 843. Similarly, the top portion 961 of the upper teeth portion 83A and the top portion 951 of the lower teeth portion 83B face one another and constituted by planes substantially parallel to one another. The top portion 951 and the top portion 961 constitute a holding portion 844.

In a state where a sheet bundle B is held between the upper teeth portion 83A and the lower teeth portion 83B, when the advancing/retracting mechanism 51A (refer to FIGS. 4A and 4B) causes the upper teeth portion 83A to advance by a predetermined amount, a gap of each of the holding portions 843 and 844 becomes a gap G4. The gap G4 has a thickness smaller than the original thickness T of the sheet bundle B.

Due to the above-described configuration, as with the holding portions 841 and 842 in the first exemplary embodiment, the holding portions 843 and 844 according to the second exemplary embodiment hold the sheet bundle B when binding processing on the sheet bundle B is performed, and the upper teeth portion 83A and the lower teeth portion 83B may thereby be suppressed from being shifted or inclined.

Third Exemplary Embodiment

Figure 11:
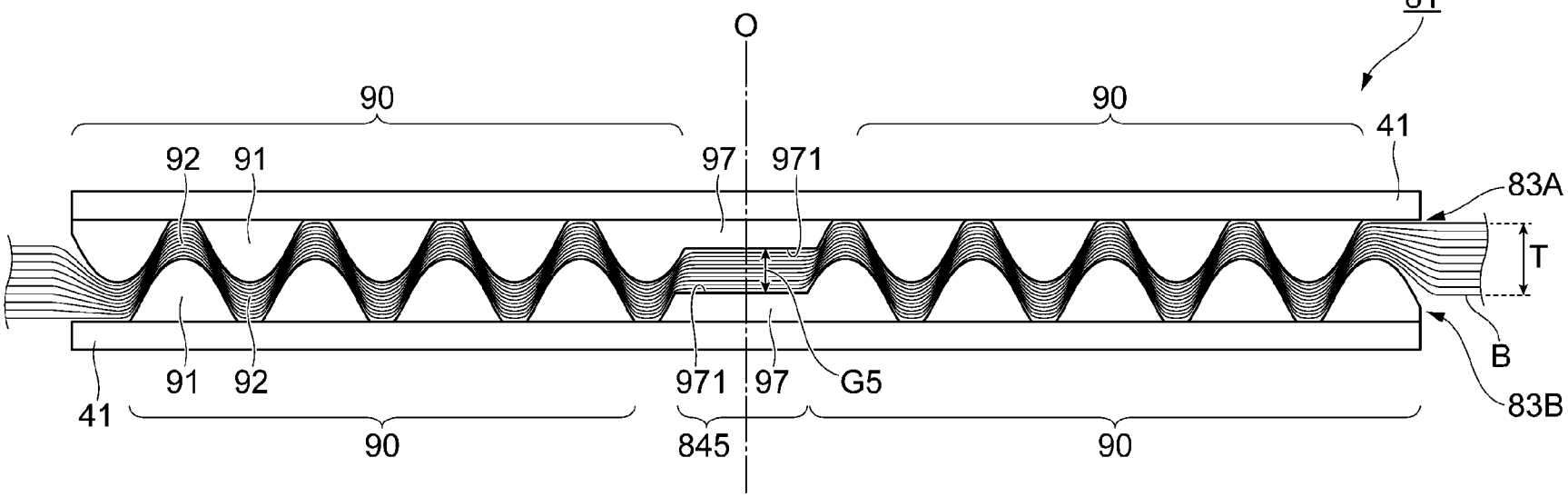
FIG. 11 illustrates a binding member having a holding portion in a center portion of teeth rows.

FIG. 11 illustrates a binding member 81 according to a third exemplary embodiment. A feature of the third exemplary embodiment is a configuration where a holding portion is provided in a center portion having a center O of the length of the teeth rows 90 of each of an upper teeth portion 83A and a lower teeth portion 83B in a direction where the teeth rows 90 are arranged side by side. Note that, in the third exemplary embodiment, constituents similar to those of the first exemplary embodiment are denoted by the same references, and the detailed description of the constituents will be omitted.

In the present exemplary embodiment illustrated in FIG. 11, regarding each of the upper teeth portion 83A and the lower teeth portion 83B, a protrusion 97 is provided in the center portion having the center O of the length of the teeth rows 90 in the direction where the teeth rows 90 are arranged side by side. As a result, each of the upper teeth portion 83A and the lower teeth portion 83B has the teeth rows 90 at two positions between which protrusion 97 is disposed.

The protrusion 97 protrudes in the protruding direction where projecting portions 91 protrude and has a top portion 971 at the distal end thereof in the protruding direction.

As FIG. 11 illustrates, the top portion 971 of the upper teeth portion 83A and the top portion 971 of the lower teeth portion 83B face one another and constituted by planes substantially parallel to one another. The two top portions 971 facing one another constitute the holding portion 845.

In a state where a sheet bundle B is held between the upper teeth portion 83A and the lower teeth portion 83B, when the advancing/retracting mechanism 51A (refer to FIGS. 4A and 4B) causes the upper teeth portion 83A to advance by a predetermined amount, a gap of the holding portions 845 becomes a gap G5. The gap G5 has a thickness smaller than the original thickness T of the sheet bundle B.

Due to the above-described configuration, as with the holding portions 841, 842, 843, and 844 in the first and second exemplary embodiments, the holding portion 845 according to the third exemplary embodiment holds the sheet bundle B when binding processing on the sheet bundle B is performed, and the upper teeth portion 83A and the lower teeth portion 83B may thereby be suppressed from being shifted or inclined.

Modifications

In the above-described exemplary embodiments, the protrusions 93, 94, 95, 96, and 97 constituting the holding portions 841, 842, 843, 844, and 845 are lower in height than the top portion of each projecting portion 91 and greater in height than the base portion 41. However, as long as a holding function is provided, the protrusions 93, 94, 95, 96, and 97 may also be formed so that one of the facing protrusions does not protrude, and the other protrusion is greater in height than the top portion of the projecting portion 91. However, a sheet bundle B is easily inserted into a region between the upper teeth portion 83A and the lower teeth portion 83B by forming both protrusions facing one another lower in height than the top portion of the projecting portion 91 and greater in height than the base portion 41, as with the above-described exemplary embodiments.

In each of the above-described exemplary embodiments, the lower teeth portion 83B and the upper teeth portion 83A have the same toothed shape. However, the upper teeth portion 83A and lower teeth portion 83B may alternatively have different shapes.

In addition, regarding the holding portions 841, 842, 843, 844, and 845 in the above-described exemplary embodiments, the number thereof is not limited to that in the above-described examples and may also be increased appropriately.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A binding device comprising:

an upper teeth portion having at least one teeth row that forms unevenness in a recording material bundle;

a lower teeth portion having at least one teeth row that forms unevenness in the recording material bundle and being paired with the upper teeth portion; and at least one holding portion that holds the recording material bundle at a position different from a position where the upper teeth portion and the lower teeth portion have a binding function, when binding processing is performed by the upper teeth portion and the lower teeth portion, wherein an entirety of teeth of the at least one teeth row of the upper teeth portion are spaced apart from each other, and an entirety of teeth of the at least one teeth row of the lower teeth portion are spaced apart from each other.

2. The binding device according to claim 1, wherein the at least one holding portion is disposed side by side with the at least one teeth row of the upper teeth portion and the at least one teeth row of the lower teeth portion.

3. The binding device according to claim 2, wherein the at least one holding portion includes two holding portions disposed at both ends of the at least one teeth row of each of the upper teeth portion and the lower teeth portion.

4. The binding device according to claim 2, wherein the at least one teeth row of the upper teeth portion includes two teeth rows and the at least one teeth row of the lower teeth portion includes two teeth rows, and wherein the at least one holding portion includes a holding portion that is disposed between the two teeth rows of the upper teeth portion and between the two teeth rows of the lower teeth portion.

5. The binding device according to claim 4, wherein the at least one holding portion is disposed in a center portion including a center of each teeth row of the upper teeth portion and the lower teeth portion in a longitudinal direction in which teeth of each teeth row of the upper teeth portion and the lower teeth portion are arranged.

6. The binding device according to claim 1, further comprising:

a load unit that applies a predetermined load through the upper teeth portion, the lower teeth portion and the at least one holding portion to the recording material bundle held between the upper teeth portion and the lower teeth portion, when the binding processing is performed, wherein a maximum stress applied to the recording material bundle by the at least one holding portion under the load applied by the load unit is smaller than a maximum stress applied to the recording material bundle by the at least one teeth row of the upper teeth portion and the at least one teeth row of the lower teeth portion under the load.

7. The binding device according to claim 6, wherein the maximum stress applied to the recording material bundle by the at least one holding portion under the load applied by the load unit is smaller than or equal to half the maximum stress applied to the recording material bundle by the at least one teeth row of the upper teeth portion and the at least one teeth row of the lower teeth portion under the load.

* * * * *